United States Patent [19]

Kleinschmidt

[11] 4,037,546

[45] July 26, 1977

[54] SEWING MACHINE APPARATUS FOR ALIGNING AND SEWING PIECES OF TEXTILE FABRIC OR THE LIKE

[75] Inventor: Johann Otto Kleinschmidt, Karlsruhe, Germany

[73] Assignee: Union Special G.m.b.H., Stuttgart, Germany

[21] Appl. No.: 709,051

[22] Filed: July 27, 1976

[51] Int. Cl.[2] ..... D05B 21/00

[52] U.S. Cl. ..... 112/121.26; 112/207; 112/209; 112/212; 226/111

[58] Field of Search ..... 112/121.26, 121.27, 112/121.11, 121.12, 121.15, 153, 152, 207, 208, 209, 210, 212, 203; 226/32, 111, 112, 115

[56] References Cited

U.S. PATENT DOCUMENTS

| | | | |
|---|---|---|---|
| 3,262,410 | 7/1966 | Chernes | 112/212 |
| 3,867,889 | 2/1975 | Conner, Jr. | 112/121.11 |
| 3,903,818 | 9/1975 | Marjorio | 112/121.15 |
| 3,911,840 | 10/1975 | Marjorio | 112/153 |
| 3,954,071 | 5/1976 | Mall et al. | 112/207 |

FOREIGN PATENT DOCUMENTS

| | | | |
|---|---|---|---|
| 286,749 | 8/1915 | Germany | 112/212 |
| 2,457,535 | 9/1976 | Germany | 112/121.26 |

*Primary Examiner*—H. Hampton Hunter
*Attorney, Agent, or Firm*—John W. Harbst; John A. Schaerli

[57] ABSTRACT a sewing machine apparatus for aligning one side of a series of fabric panels in a predetermined position. The apparatus includes measuring devices which associate with and continually monitor the position of one side of the fabric panels with respect to each other. A control means, responsive to the output of the measuring means, selectively advances or retards the top feeding mechanism engaging with the top layer or fabric or the bottom feed mechanism engageable with the bottom layer of fabric, as may be necessary, whereby aligning one side of the fabric panels at the completion of the sewing operation.

19 Claims, 10 Drawing Figures

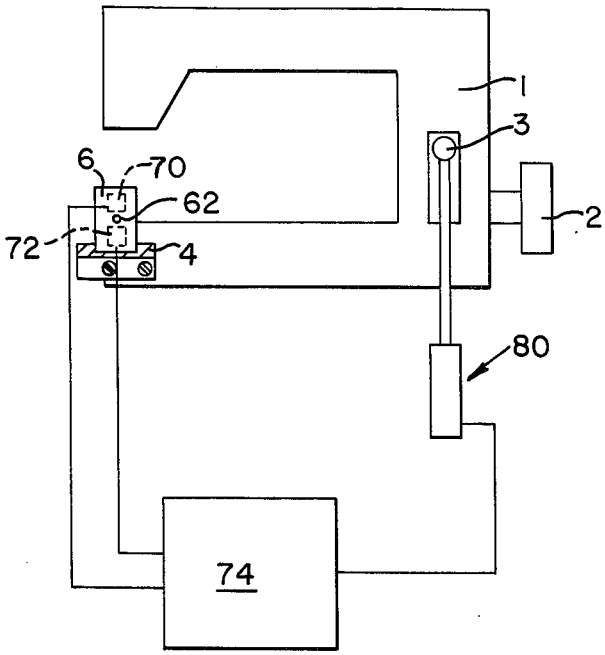
FIG. 1
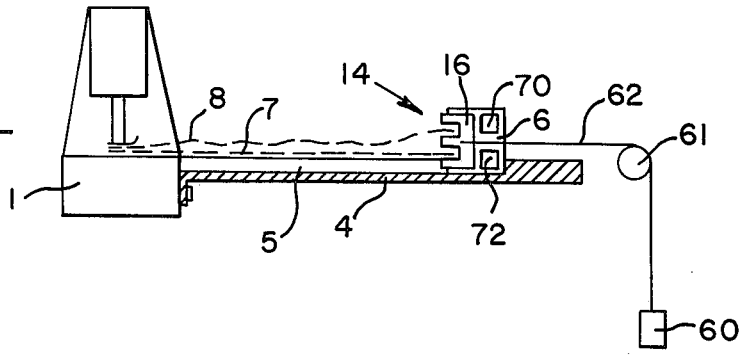
FIG. 2
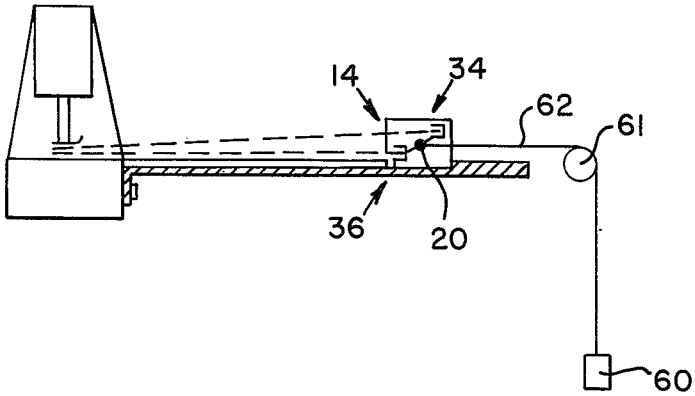
FIG. 3
FIG. 4
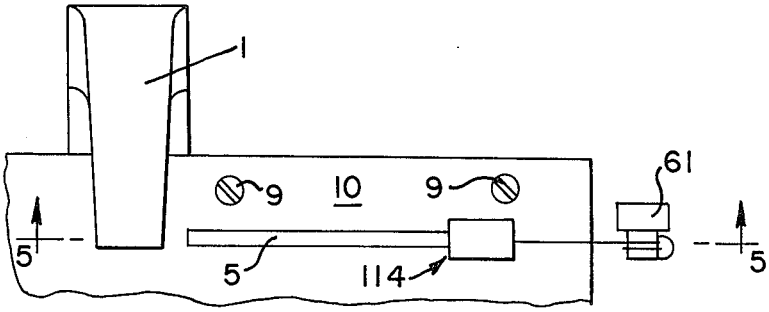

FIG. 8
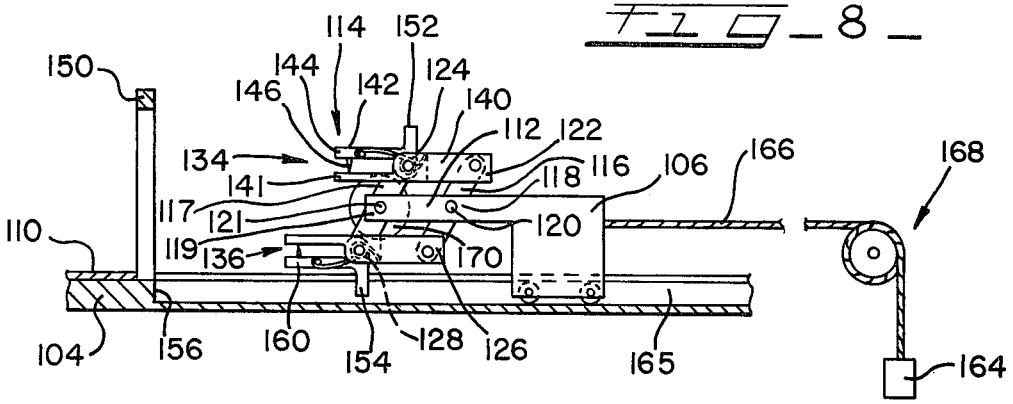
FIG. 9
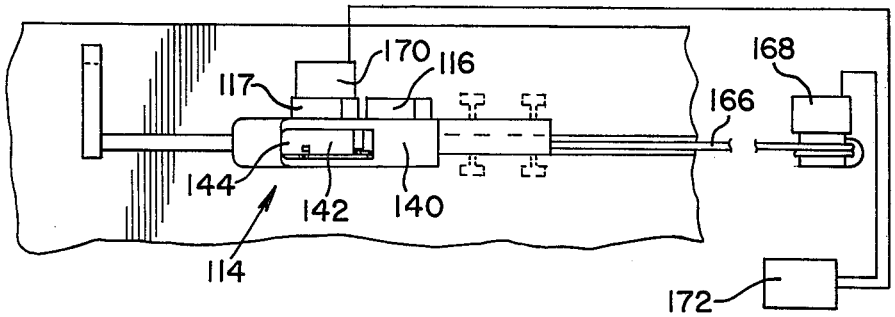
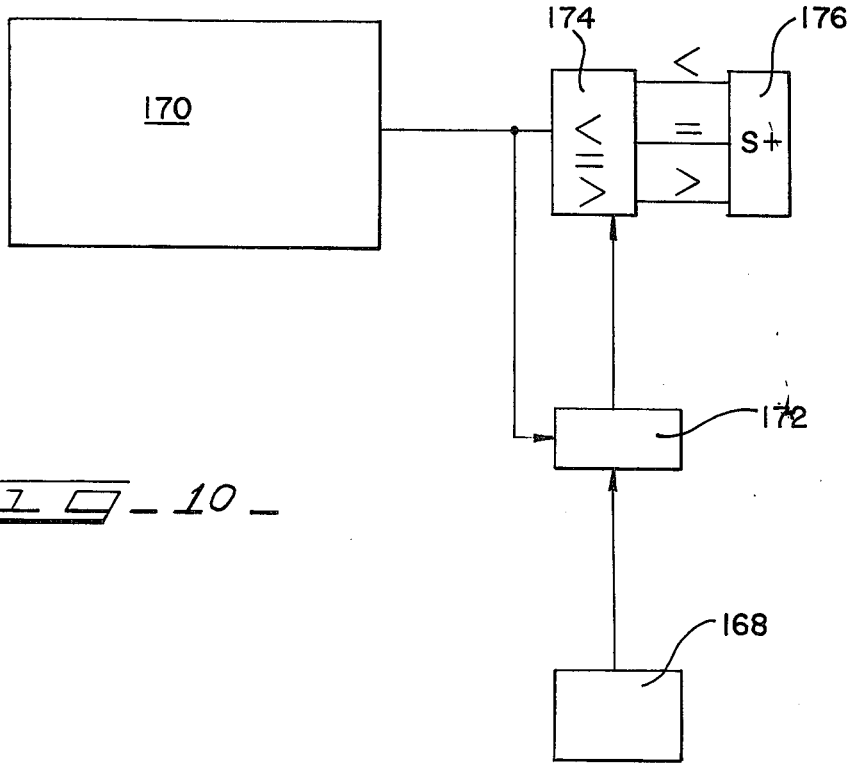
FIG. 10

SEWING MACHINE APPARATUS FOR ALIGNING AND SEWING PIECES OF TEXTILE FABRIC OR THE LIKE

This invention relates in general to the construction of sewing machines and, in particular, to an apparatus which monitors and positions in a predetermined manner, one side of a series of fabric plies.

BACKGROUND OF THE INVENTION

In a substantial number of sewing operation, such as the fabrication of pants, jackets, etc., wherein two pieces of material sewn together it is desired that the beginning and trailing ends of the two fabric plies be sewn so that these ends match upon completion of the sewing operation. The result of evenly matched plies at the end of the sewing operation is desired even though the pieces may be of unequal length when they are received from the cutting room. When pieces of unequal lengths are to be sewn, and to achieve the desired results, it is necessary for the operator to hold back on the shorter of the two plies which therefore advances the effective feed rate of the longer ply. The operation of manually adjusting the effective feed rate of the two plies is difficult to master and therefore requires the employment of a skilled operator. During the sewing operation, it is also possible for the material layers to be mutually displaced. This situation usually applies when materials are used that are difficult to sew to each other, that is, one of the material layers advances more or less than the other layer. For whatever reason it may be, that is, the unequal lengths or the difference in the effective feed length of the materials, due to the type of materials which are to be sewn, the desired result of end matching, both the beginning and trailing ends of the fabric plies is still desired.

DESCRIPTION OF PRIOR ART

Because of the above stated situations, many manufacturers have attempted to employ automated sewing operations to achieve the desired results of end matching the fabric plies. It is already known, in the patent literature, as for example, in U.S. Pat. No. 3,867,889 how to use a control device for controlling the sewing machine feed by monitoring the ends of two plies for fabric matching. It is disclosed in this patent to use two sensor units for monitoring the fabric ends. One sensor unit senses the trailing ends at the beginning of the sewing operation and a second sensing unit senses the trailing ends when approximately half of the feed length of the work pieces have been sewn. These sensor units are provided to correct the feed ratio of a differential feed means employed for advancement of the fabric. One of the drawbacks in using a device such as this, is the fact that the feed ratio is adjusted only twice, that is, at the beginning of the sewing and after sewing half of the length of the seam. The provision of a second sensor for correcting the adjusted feed ratio set by the first sensor reveals that it is difficult to adjust the feed to the correct ratio by using only one sensor unit.

It is also known, in the patent literature; as for example, in U.S. Pat. No. 3,954,071 how to employ a series of measuring elements for sensing the actual feed length of the fabric plies. These measuring elements are situated in front of the stitch forming instrumentalities and they act as an impulse transmitter for an adjusting device which synchronizes the feed length of the two fabric layers. As long as the actual feed length of the two material layers are equal to each other, the number of impulses produced by the two measuring wheels are identical and therefore no adjustment of the feed means is necessary. As soon as the actual feed lengths of the two materials differ, the rotational speed of the two measuring wheels are no longer equal to each other. Therefore, an adjustment of the feed dog is in order to obtain mutually equal feed lengths of the two material layers. It is evident that the feed distances covered by the individual material layers are instantly equalized whenever a difference appears between the feed lengths. Because of the two measuring elements, it is insured that the two material layers will be connected to each other in an aligned position and that any layer displacement during the sewing operation will be instantly corrected. As may be apparent, a drawback with this type of device is the fact that if the fabric plies begin at an unequal length, the sensing or measuring means associated with this device will control the effective feed length of the fabric plies so that they will end up unequal when the sewing operation is completed.

SUMMARY OF THE INVENTION

This invention is directed to an apparatus which aligns one side of a series of fabric panels in a predetermined manner. For this purpose, in accordance with the invention, each of the fabric panels is held at its bottom side by a clamping assembly. The clamping assembly includes a number of bell crank levers which are spring biased and pivotally secured to a vertically standing connecting link. These levers are provided with securing means whereby enabling them to securely hold one side of the material pieces which are to be sewn. It should be pointed out, that the number of bell crank levers employed with this apparatus depends upon the number of fabric pieces which are to be sewn. The connecting link is pivotally carried by a carrier means which is guided to and from the sewing area by a guiding slot provided within a horizontally extending support. The carrier means is prestressed against the feed of the sewing machine whereby placing the fabric pieces under a slight stress prior to sewing. A mismatching of the fabric pieces prior to or during the sewing operation will be continuously measured by the measuring means. While the carrier moves from its initial position, remote from the sewing area, to an area within close proximity of the stitch forming instrumentalities, movement of the upper layer of fabric against the lower layer of fabric, for reasons stated earlier, may occur resulting in a mismatch of their ends. As stated above, it is also possible that the bottom portions of the work pieces may be unequal from the initiation of the sewing operation. For whatever reason, a mismatch in the fabric plies causes pivotal rotation of the vertical connecting link. The angular disposition of the connecting link is constantly measured by a measuring assembly means. As soon as the measuring assembly means senses a difference in the relative alignment of the layers of material a corrective value is fed to a control device which is connected to a differential feed mechanism of the sewing machine whereby changing the feed stroke of the upper or lower feed of the sewing machine accordingly. In this manner, it is possible to measure the relative alignment continuously at the end of the material plies. By continuously measuring the positions of the fabric ends with respect to each other it is possible to control the differential feed means so that the desired effect of aligning the fabric plies, both at the beginning and end of the seams is obtained.

Accordingly, it is an object of the invention to provide a sewing machine for sewing a plurality of material layers, which includes a differential feed means which is responsive to means capable of controlling the feeding of two fabric plies.

Another object of this invention is to provide an apparatus which continuously measures the difference in the effective length of the material plies to and continuously during the sewing operation.

Another object of this invention is to provide an apparatus for controlling the effective feed length of material plies which can be programmed to distribute differences in the effective length of the pieces being sewn over the entire length of the fabric pieces.

It is yet another object of this invention to provide an apparatus which measures the difference in the alignment of the fabric plies at their end portions.

Yet another object of this invention is to provide an apparatus which continuously measures the difference in the relative alignment of the fabric plies prior to and continuously during the sewing operation.

The various features of novelty which characterize the invention are pointed out with particularity in the claims annexed to and forming a part of this disclosure. For a better understanding of the invention, its operating advantages and specific objects attained by its uses, reference should be made to the accompanying drawings and descriptive matter in which there is illustrated preferred embodiments of the invention.

BRIEF DESCRIPTION OF THE DRAWING

In the drawings:

FIG. 1 is a schematic representation of a sewing machine with the alignment apparatus and control system attached thereto as viewed from the front.

FIG. 2 is an end view, schematically representing the sewing machine and aligning apparatus for continually measuring the length of the material work pieces prior to the initiation of the sewing cycle.

FIG. 3 is an end view, schematically representing the sewing machine and the clamping mechanism prestressing a pair of mismatched material work pieces prior to sewing.

FIG. 4 is a top elevational view, schematically representing the sewing machine and alignment apparatus.

FIG. 8 is a fragmentary side elevational view, taken partly in section, of another embodiment of a clamping and aligning apparatus according to the present invention.

FIG. 9 is a top elevational view of the embodiment shown in FIG. 8.

FIG. 10 shows a schematic view of the control and logic system.

DESCRIPTION OF THE PREFERRED EMBODIMENTS

Figure 5:
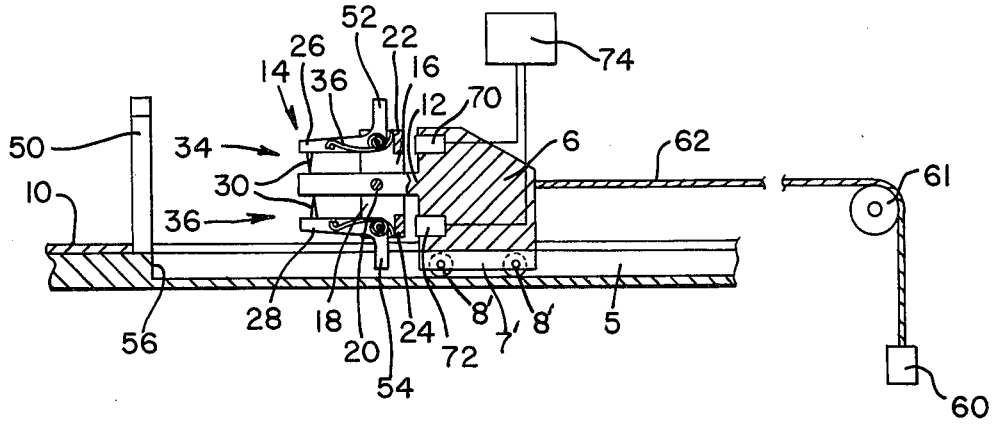
FIG. 5 is a fragmentary side elevational view, taken partly in section, showing a detailed view of the clamping and aligning apparatus.

Turning now to the drawings and more particularly to FIG. 1 wherein is shown a sewing machine 1, which is provided with a drive pulley 2 and a differential feed system means 3, as is well known in the art. The differential feed adjustment means is comprised of a first feeding device (not shown) for engaging and feeding the top material layer and a second feed device (not shown) for engaging and feeding a lower material work piece. Fixedly held and supported by the base of the sewing machine 1 is a flat horizontally extending table or support means 4. The support means 4 is provided with a guide means 5 which extends in a path substantially parallel to the feed path direction of the material work pieces.

As viewed in FIGS. 2 and 3, to the right of the sewing instrumentalities associated with the machine 1, is a carrier means 6. The carrier means 6 is effectively guided within the guideway means 5 in a manner which will hereinafter be described.

As may be best seen in FIG. 5, the lower end means 7 of carrier means 6 is designed so as to be guided in a sliding relationship with the guideway means 5. Provided on the end means 7' are a plurality of roller means 8 which aid in guiding the carrier means 6 toward and away from the sewing instrumentalities. A plate means 10 is secured by any suitable means, such as 9 (FIG. 6) to the top side of the table or support means 4 so that the carrier means 6 is forcibly guided within the track formed between the top plate 10 and guideway means 5.

Figure 7:
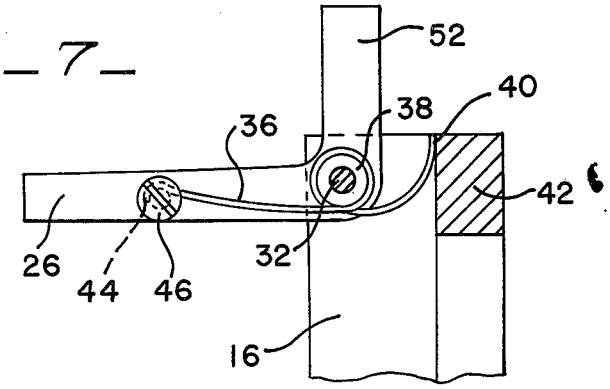
FIG. 7 is a fragmentary side elevational view, taken partly in section, along line 7—7 of FIG. 6.

The carrier means 6 is provided with an extending arm means 12. The arm means 12 serves as a pivotal support means for a double clamp assembly means 14. The double clamp assembly means 14 is employed to securely hold the ends of the material work pieces which are to be aligned and sewn. As is best viewed in FIGS. 5 and 7, the double clamping assembly includes a top clamping assembly 34 and a bottom clamping assembly 36 which are secured to a U-shaped link means 16. The link means 16 is pivoted at its center portion 18 about a pin means 20 carried by the arm means 12. The clamp link means 16 has provided at its first end means 22 and its second end means 24, pivotally secured bell crank lever means 26 and 28 respectively. It should be noted that the arm means 12 extends in a direction toward the sewing machine needle between the bell crank lever means 26 and 28. The bell crank lever means 26 and 28 are provided with needle-like pins 30, which serve to secure the ends of the material work pieces 7 and 8 against the arm means 12.

Due to the similar construction of the top clamping assembly 34 and the bottom clamping assembly 36, only one; namely, the top clamping assembly 34, will be described in detail. As is viewed in FIGS. 6 and 7, the link means 16 is of a generally U-shaped construction. The bell crank lever means 26 is pivotally secured to the link means 16 by a pin means 32. A spacer means 38 is provided between the lever means 26 and the link means 16 enabling a spring means 36 to be positioned around the spacer means 38 in a well known manner. That is, one leg 40 of the spring means 36 is held against a rear wall 42 of the link means 16 while the compressive nature of the spring design provides that the second leg means 44 of the spring means 36 places a downward force against the screw means 46 carried by the lever means 26 whereby maintaining the bell crank lever means 26 in the position as illustrated in FIG. 5 when the clamp is closed. The provision of the spring means 36 yielding a downwardly directed force against the lever means 26 provides a disengageable connection between the pin means 30 and the arm means 12. It would also be possible to position between bell crank lever 26 and the back portion 42 of the link means 16 a permanent magnet which would also provide a disengageable connection as well as keep the bell crank 26 in the position as illustrated when the clamp is closed.

Figure 6:
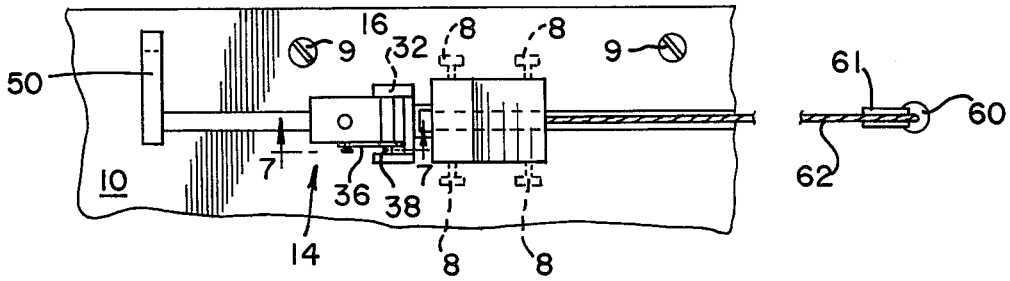
FIG. 6 is a top elevational of the clamping and aligning apparatus as shown in FIG. 5.

As is shown in FIGS. 5 and 6, there is a stop means 50 which is secured to the table or support means 4. As the material work pieces 7 and 8 are advanced by the differential feed means toward the stitch forming instrumentalities, the carrier means and therefore the clamping assembly means 14 is drawn to the left. The continued advancement of the material work pieces 7 and 8 will cause the portions 52 and 54 of the levers 26 and 28 to engage the stop means 50 and the stop means 56 formed in the table means 4. As the portions 52 and 54 of levers 26 and 28 run against these stop means, the levers 26 and 28 will rock about their respective pivot points and free the material from the clamping assembly 14.

According to the embodiment as shown in FIGS. 1 through 7, the carrier means 6 is connected to a weight means 60 via a cable means 62 which is wound about a pulley means 61 whereby the carrier means 6 is continually biased in a direction opposite to that of the differential feed means. In this manner when the material ends leave the pins 30 whereby freeing them from the clamping assembly 14, the weight 60 will return the carrier means 6 and the clamping means 14 into the original or initial position shown in FIGS. 2 and 3.

Fixedly secured within the carrier means 6 are proximity sensor means 70 and 72. The sensor means 70 and 72 are spaced an equal distance from the link means 16 when the link is in the vertical position as shown in FIG. 5. The vertical position of the link means 16, as shown in FIG. 5, is that position which the same assumes when the bottom side portions of the material work pieces being sewn are in alignment with each other. The proximity sensor means 70 and 72 serve to measure the distance values, that is, the distance measured by the first sensor means 70 relative to the first end means 22 of link means 16, while the second sensor means 72 measures the distance between the second end means 24 of link 16 and itself. Each of these distance values are then sent to a calculator means 74 where they are compared as to their respective values as will be discussed hereinafter. The calculator means 74 is connected to a control device means 80 (FIG. 1) which serves to change the feed of the top feed means relative to the bottom feed means when actuated by the calculator means 74. The control device means 80 is comprised of a stepper motor 82 which is connected to the differential feed means 3.

During operation of the machine, the material work pieces 7 and 8 and more specifically the bottom portion means thereof are clamped and held by the double clamping assembly means 14. As was discussed above, and as may be noted from FIGS. 1 and 2, prior to sewing, the weight means 60 has moved the carrier means to a position remote from the sewing area. The weight means 60 places a slight stress on each of the material work pieces prior to sewing. Even though a differential feed means is used, while moving from this remote or initial position toward the sewing area, the upper ply 8 of the material work pieces may move faster or slower than the lower work piece 7 for reasons stated earlier. This preponderant moving of either ply will result in a mismatch of the bottom side portions. The difference in the relative alignment of either the top or bottom plies will affect rotation of the link means 16 (FIG. 2) about the pivot pin means 18 thus changing the distance values measured by the proximity sensor means 70 and 72. As was discussed earlier, the calculator means 74 compares each of the values received from the proximity sensors 70 and 72. When the distance value of the first measuring means 70 varies from that of the distance value measured by the second measuring means 72, due to rotation of the link means 16, the calculator means immediately senses the difference between the two distance values. When the calculator means senses a difference between the distance values supplied by the first and second measuring means, it signals the control means whereby adjusting the feed ratio of the upper feed means with respect to the lower feed means for a period of time until the bottom side portions of the material work pieces are in alignment. Once the bottom side portions of the material work pieces are in alignment the link means 16 will be in a vertically upstanding manner as shown in FIG. 5 and both measuring means 70 and 72 will sense a distance value which will be equal. The calculator means 74 senses this equalization and thus adjusts the control means whereby the top and bottom ply feed means are adjusted so that they remain equal until such time as movement of either ply becomes preponderant. As may be appreciated, with this type embodiment it is possible for the measuring means to continuously measure the bottom side portions of the fabric plies from a point remote from the sewing area up to a point within close proximity with the sewing area whereby alignment of the bottom side portions of the material work pieces is attained.

As shown in FIGS. 1 to 7 a preferred embodiment for end matching bottom side portions of material work pieces during the sewing operation by using a plurality of measuring means has been disclosed. As may be appreciated, other preferred embodiments are possible. One such embodiment would be to set the calculator means 74 to a preset value. In this manner it would be necessary only to use one proximity sensor to actuate the control device according to a value which is different from that of the predetermined value set within the calculator means 74. Once the values differ, the feed ratio would be corrected whereby preponderant movement of one ply would be employed until such time as the measuring means senses that the bottom side portions are in an aligned position with respect to each other.

While the embodiment shown in FIGS. 1 to 7 is used for proper end matching of work pieces which are of substantially equal lengths, the embodiment shown in FIGS. 8, 9 and 10 is used to equalize the bottom portions of material work pieces which are cut to different lengths.

As was the case in FIGS. 1 to 7, with the embodiment shown in FIGS. 8 and 9, there is also a table or support means 104 which is fixedly held and supported by the base of the sewing machine 1. The support means 104 is provided with a guide means 105 having a plate means 110 fixedly attached to its top surface whereby serving the purpose of guiding a carrier means 106 to and from the sewing instrumentalities associated with the machine 1 as was described above.

The carrier means 106 is provided with an extending arm means 112 which serves as a pivotal support for a double clamping assembly means 114. As may be best viewed in FIGS. 8 and 9 the double clamping assembly 114 includes a top clamping assembly 134 and a bottom clamping assembly 136 which are pivotally secured to two parallel link means 116 and 117. The link means 116 and 117 are pivoted at their center portion means 118 and 119 about a pin means 120 and 121 respectively. The pin means 120 and 121 are carried by the arm means 112 of the carrier means 106. The link means 116 and 117 form part of a parallelogram type assembly and carry at their first end means 122 and 124 the top clamping assembly means 134. The lower end means 126 and 128 of the parallelogram linkage assembly pivotally carries the bottom clamping assembly 136. The top and bottom clamping assemblies 134 and 136 serve to secure the ends of the material work pieces 7 and 8.

The top and bottom clamping assemblies 134 and 136 are designed in much the same manner as were the top and bottom clamping assemblies 34 and 36 of the embodiment shown in FIGS. 5 and 6. That is, there is pivotally carried on the link means 116 and 117 a bar means 140. Pivotally secured and biased in a downward direction by the suitable spring means described above is a bell crank lever means 142. The bell crank lever means has secured at its forward end 144 a pin means 146 which serves to clamp the pertinent work piece against the extended end means 141 of bar means 140. The stop means 150 and 156 associate with the top and bottom clamping assembly to serve the same purpose as was described in the embodiment shown in FIG. 5. That is, the portion means 152 of the lever means 142 engages the stop means 150 whereby pivoting the same releasing the fabric. At the same time the portion means 154 of lever means 160 engages the stop means 156 thus pivoting the lower lever means 160 about its pivot point whereby releasing the fabric clamped therein.

According to the embodiment shown in FIGS. 8 and 9, the carrier means 106 is connected to a weight means 164 via a cable means 166 which is wound around a polar or cog wheel assembly means 168. The purpose of the weight 164 is to place a slight stress on the material work pieces 7 and 8 as they are advanced to the sewing instrumentalities, as well as to supply a return force to the carrier means 106 once the material work pieces have been released from the clamping assembly 114. The purpose in winding the cable 166 around the cog wheel 168 is such that, once the carrier means 106 is returned from close proximity with the sewing area the length of the two fabric plies which are to be sewn can be accurately determined by the number of pulses generated by the cog wheel means 168. The pulses generated by the cog wheel 168 are a direct measurement of the fabric plies whereby it is possible to determine the length of the two fabric plies which are to be sewn prior to the sewing operation.

As was discussed earlier, the link means 117 is pivoted about the pin means 121. It should also be noted that the link means 117 is fixedly secured to the pin means 121 such that displacement of the link means 117 from a perpendicular arrangement with the table or support means 104 rotates the pin means 121. As is viewed in FIG. 9, the pivot pin means 121 is connected to a measuring means 170. The measuring means 170 serves to measure the angular position of the parallel link means 117 as compared to its position perpendicular to the top side of the support 104. Such a measuring device could be constructed by the use of a potentiometer means in a well known manner.

As may be best viewed in FIGS. 9 and 10, the potentiometer means 170 is connected to a calculator means 172 thus supplying the calculator means 172 with a value which is reflective of the angular disposition of the link means 117 relative the support means 110. This may be described, such that the potentiometer means 170 will supply a value equal to zero when the link means 117 is perpendicular to the support means 110. As the angular disposition of the link means 117 changes from the perpendicular position a variable value equal to more or less than zero will reflect the amount that the link means 117 rotates. This value also represents the direction in which the link is directed. It should be noted that when the link means 117 is perpendicular to the support means 104, the bottom side portions of the material work pieces are aligned with each other. Also connected to the calculator means 172 is the polar or cog wheel means 168. The polar or cog wheel means 168 supplies to the calculator a measured distance which is identical with the length of the material work pieces which have to be sewn. By connecting both the measuring means, which supplies a value reflective of the distance by which the bottom portions of the material work pieces are misaligned, and the polar measuring means yielding a second value reflective of the entire lengths of the work pieces it is possible to distribute along the entire length of the fabric work pieces the distance by which the bottom portions are misaligned. Connected to the calculator means 172 is a control device means 174 which serves to change the ratio of the top feed assembly means relative the bottom feed assembly means. The control device means 174 includes a stepper motor 176 which retards or advances the differential feed means as is dictated to by the calculator means 172.

Assuming that mismatched fabric plies are to be sewn the operation of the machine is as follows: The material work pieces, and more specifically the bottom portion means thereof, are clamped and held by the double clamping assembly means 114 while the top portion means are secured beneath the presser foot (not shown) of the machine 1. As was discussed earlier, the weight means 164 has moved the carrier means 106 to a position removed from the sewing area and also has allowed the cog wheel means 168 to measure the distance of the fabric plies which are to be sewn. The weight means 164 places a slight stress on each of the material work pieces before and continually during the sewing operation. The mismatched alignment of the top clamp assembly 134 and the bottom clamping assembly 136, caused by the difference in the length of the work pieces to be sewn is immediately sensed by the calculator means 170 due to the displacement of the link means 117. This results because the link means 117 is not in a position perpendicular to the support means 110. A value, reflective of the angular disposition of the link 117 is supplied to the calculator means 172. When the calculator means received this variable value which is more or less than zero from the sensor means 170, a corrective value is supplied to the control means 174. It should be noted that this corrective value supplied to the control means 174 is a value which will allow the misalignment of the bottom portions of the fabric plies to be distributed over the entire length of the work portions. This is made possible because of the effective length of the fabric plies measured by the polar wheel 168 and also supplied to the calculator 172. By the arrangement of the measuring means 170 being carried by the carrier means 106 it is possible to continuously measure the angular position of the link means 117 whereby continually adjusting the feed ratio of the upper feed means with respect to the lower feed means whereby bringing the bottom side portions of the fabric plies into alignment with each other. As was stated earlier, once the link means 117 attains a position which is perpendicular to the support means 104, no further adjustment of the differential feed means is called for.

As may be appreciated it is within the scope of this invention to supply a preset value to the calculator means 172 thus eliminating the need for the cog wheel means 168. In this manner the measuring means 170 would supply a variable value which is then compared to th preset value stored within the calculator means. Once the value from the measuring means 170 differs from that within the calculator means, a corrective value will be supplied to the control means whereby the differential feed means ratio can be adjusted to align the bottom side portions of the fabric panels in a predetermined manner as was discussed above.

It should also be appreciated that it is within the scope of this invention to compensate for the length difference of the fabric plies at different rates over the total length of the fabric plies. In a device of this sort a preprogrammed unit could be used for generating the value applied in the embodiment shown in FIG. 9 by the polar or cog wheel means 168. The preprogrammed unit can be controlled by a punched tape coupled to the feed drive mechanism of the sewing machine.

From the foregoing description it should be readily appreciated that the above described apparatus is an effective device for aligning one side of a series of fabric panels in a predetermined position. By connecting a measuring device which continuously monitors the position of one side of the fabric panels with respect to the other and connecting this measuring device with a control means which is responsive to the output of the measuring means, it may be seen how the feed ratio of the differential feed means selectively advances or retards the top feeding mechanism or the bottom feeding mechanism whereby aligning the bottom side of the fabric panels at the completion of the sewing operation.

Thus it is apparent that there has been provided in accordance with the invention, a sewing machine apparatus that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In combination, a sewing machine having differential feed means for engaging and feeding a overlying series of fabric panels and an apparatus for aligning a mismatched trailing end portion means of said fabric panels in a predetermined position comprising:

means for accepting and holding each of said end portion means of said fabric panels and movable therewith;

means for continuously sensing the position of each of said end portion means relative each other during the sewing operation; and means connected to said sensing means for selectively advancing or retarding the relative rate of feed of said differential feed means thereby aligning each of said end portion means upon completion of the sewing operation.

2. The apparatus of claim 1 including:

guide means whereby said apparatus may be moved in a controlled manner with respect to said sewing machine.

3. The apparatus for aligning said portion means of claim 1 wherein:

said means for continually sensing includes a series of sensor means corresponding to the series of fabric panels; and said means for accepting and holding includes a series of accepting and holding means corresponding to the series of sheet means.

4. A sewing machine attachment for use in combination with a sewing machine having top feed means for feeding a top layer of material, bottom feed means for feeding a bottom layer of material, the trailing end of one of said layers being mismatched with respect to the corresponding trailing end of the other layer, said attachment comprising:

a movable carrier means;

means pivotally connected to said carrier means, said means accepting and holding a series of overlying sheet means;

measuring means for continuously measuring the position of said pivotally connected means; and control means connected to said measuring means to cause it to vary the relative speed of said top and bottom feed means in accordance with the position of said pivotally connected means whereby to align the ends of said sheet means at the end of the sewing operation.

5. An apparatus according to claim 4 wherein:

said means for accepting and holding a series of sheet means holds said material plies at their ends.

6. An apparatus according to claim 4 wherein:

means are provided for prestressing said movable carrier means against the feed of said sewing machine.

7. An apparatus for use in combination with a sewing machine having differential feed means, and means for matching the mismatched ends of a plurality of overlying fabric plies upon completion of a sewing operation, said means comprising:

a carrier means capable of movement in the feed direction;

clamping member means pivotally carried by said carrier means, said clamping member means being coupled with the ends of said fabric plies;

means for prestressing the fabric prior to sewing;

sensor means carried by said carrier means for producing a first value means relative to the distance between said clamping member means and said sensor means;

calculator means capable of producing a second predetermined value means; and control means connected to said sensor means and said calculator means for changing the relative rate of feed of said differential feed means when said first and second values differ.

8. An apparatus for use in combination with a sewing machine having differential feed means, stitch forming instrumentalities and means for matching the mismatched ends of a plurality of overlying fabric plies upon completion of a sewing operation, said means comprising:

a carrier means capable of movement in the feed direction;

clamping member means having first and second end means and being pivotally carried by sid carrier means, said clamping member means being coupled with the end of said fabric plies;

means for prestressing the fabric prior to sewing;

first sensor means for producing a first value reflective of the distance between the first end means of said clamping means and first sensor means;

second sensor means for producing a second value reflective of the distance between the second end means of said clamping means and said second sensor means;

calculator means for comparing the said first and second values; and control means connected to said calculator means for changing the relative rate of feed of said differential feed means when said first and second values differ.

9. An apparatus according to claim 8 wherein:

said first and second sensor means are proximity sensor means.

10. An apparatus according to claim 8 and further comprising:

means for releasing said clamping means from engagement with said fabric ends when said fabric ends come into close proximity with said stitch forming instrumentalities.

11. An apparatus according to claim 8 wherein said means for prestressing the fabric prior to sewing is comprised of a weight and cable means both of which are connected to and act against the movement of said carrier means.

12. In combination, a sewing machine having differential feed means, and an apparatus for aligning the bottom side of a series of mismatched overlying fabric panels in a predetermined position, said apparatus comprising:

a horizontally extending support means having a guideway means therein, said guideway means extending in the feed path direction;

carrier means guided towards and away from said sewing machine by said guideway means;

clamping assembly means pivotally carried by said carrier means for accepting and holding a side portion means of said fabric panels;

means for continually sensing the angular disposition of said clamping means relative to said support means, including means for producing a variable value when said angular disposition of said clamping means is not in a predetermined position; and control means including means for storing a preset value, and being connected to said sensing means for comparing said sensing means variable value and said preset value whereby supplying a corrective degree of relative feeding movement to said differential feed means whereby aligning said side portion means of said fabric panel in a predetermined manner.

13. An apparatus according to claim 12 wherein said variable value is a function of the angular displacement of said clamping means relative said support means.

14. An apparatus according to claim 12 wherein said sensing means is comprised of a potentiometer means.

15. In combination, a sewing machine having differential feed means, stitch forming instrumentalities, and an apparatus for aligning the bottom side of a series of mismatched overlying sheets in a predetermined position, said apparatus comprising:

a horizontally extending support means having a guideway means therein which extends in the feed path direction;

carrier means guided towards and away from said sewing machine by said guideway means;

clamping means carried by said carrier means for accepting and holding the bottom portion means of said fabric panels;

first measuring means for measuring the lengths of said sheets prior to sewing, including means for generating a first resultant output;

second measuring means for continuously measuring the angular displacement of said clamping means including means for producing a second resultant output which is reflective of the angular displacement of said clamping means relative said support means;

control means connected to said differential feed means for regulating the feed of said differential feed means; and calculator means receiving said first and second resultant outputs and being connected to said control means to supply a corrective value to said differential feed means when said second resultant output is not zero whereby the relative rate of feed of the differential feed means is adjusted and variances in fabric length are corrected over the total length of said sheets whereby bringing the ends of said sheets into an aligned position.

16. An apparatus according to claim 15 wherein said clamping means is pivotally connected to said carrier means by a parallel bar linkage means; and said second measuring means measures the displacement of one or said parallel bars relative said support means.

17. An apparatus according to claim 15 wherein said first measuring means comprises a rotatable impulse transmitter means for measuring the length of said sheets.

18. An apparatus according to claim 15 further comprising means for releasing said clamping means from engagement with said bottom side of said sheets when said bottom side comes into close proximity with said stitch forming instrumentality.

19. An apparatus according to claim 15 wherein said clamping means includes a spring biased lever corresponding to the series of sheets.

* * * * *